US011001086B2

(12) United States Patent
Koshiba

(10) Patent No.: US 11,001,086 B2
(45) Date of Patent: May 11, 2021

(54) UP-DOWN MOVING MECHANISM AND INKJET PRINTER

(71) Applicant: MIMAKI ENGINEERING CO., LTD., Nagano (JP)

(72) Inventor: Sho Koshiba, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/815,016

(22) Filed: Mar. 11, 2020

(65) Prior Publication Data

US 2020/0298597 A1 Sep. 24, 2020

(30) Foreign Application Priority Data

Mar. 19, 2019 (JP) ..... JP2019-050767

(51) Int. Cl.
*B41J 25/308* (2006.01)
*B41J 2/01* (2006.01)

(52) U.S. Cl.
CPC ..... *B41J 25/3082* (2013.01); *B41J 2/01* (2013.01)

(58) Field of Classification Search
CPC ..... B41J 25/3082; B41J 2/01; B41J 25/3086; B41J 25/304
See application file for complete search history.

(56) References Cited

U.S. PATENT DOCUMENTS

2006/0232623 A1* 10/2006 Murcia ..... B41J 25/308 347/20
2012/0194607 A1* 8/2012 Iwasa ..... B41J 2/16511 347/29
2014/0292925 A1* 10/2014 Wanibe ..... B41J 2/16535 347/37
2016/0161567 A1* 6/2016 Park ..... G01R 31/3648 702/63

FOREIGN PATENT DOCUMENTS

JP 08-090766 * 4/1996 ..... B41J 25/308
JP 2009248559 10/2009

OTHER PUBLICATIONS

Machine translation of JP 08-090766, published on Apr. 1996 (Year: 1996).*

* cited by examiner

*Primary Examiner* — Huan H Tran
(74) *Attorney, Agent, or Firm* — JCIPRNET

(57) ABSTRACT

An up-down moving mechanism includes a support member; an up-down moving member that is formed separately from the support member and can be moved up and down with respect to the support member; a screw shaft for moving up and down the up-down moving member; a nut member that is screwed onto the screw shaft; a guide rail that guides the up-down moving member in a vertical direction; a guide block that slidably engages with the guide rail; and a gas spring that includes a cylinder and a piston rod biased in a direction projecting out from the cylinder, and that (Continued)

biases the up-down moving member toward an upper side with respect to the support member. To the support member, the screw shaft is rotatably attached, the guide rail is fixed, and the piston rod is attached.

20 Claims, 4 Drawing Sheets

UP-DOWN MOVING MECHANISM AND INKJET PRINTER

CROSS REFERENCE TO RELATED APPLICATIONS

This application claims the priority benefit of Japanese Patent Application No. 2019-050767, filed on Mar. 19, 2019. The entirety of the above-mentioned patent application is hereby incorporated by reference herein and made a part of this specification.

TECHNICAL FIELD

The present disclosure relates to an up-down moving mechanism that moves up and down a predetermined up-down moving target object. The present disclosure also relates to an inkjet printer equipped with such an up-down moving mechanism.

DESCRIPTION OF THE BACKGROUND ART

An inkjet printer that performs printing on a print medium is conventionally known (see e.g., Japanese Unexamined Patent Publication No. 2009-248559). An inkjet printer described in Japanese Unexamined Patent Publication No. 2009-248559 includes a head unit with a plurality of inkjet heads arranged in the width direction of a transport line, a frame disposed above the head unit, and an actuator that moves up and down the head unit with respect to the frame. The actuator includes a servo motor and a screw that rotates by the power of the servo motor. The inkjet printer includes an air suspension that urges both end portions of the head unit toward the upper side. In this inkjet printer, the downward load of the head unit acting on the actuator is reduced by the air suspension.

Patent Literature 1: Japanese Unexamined Patent Publication No. 2009-248559

SUMMARY

In the up-down moving mechanism that moves up and down a predetermined up-down moving target object such as a head unit described in Japanese Unexamined Patent Publication No. 2009-248559, it is preferable that the up-down moving target object be smoothly moved up and down.

The present disclosure thus provides an up-down moving mechanism that can smoothly move up and down an up-down moving target object in the up-down moving mechanism for moving up and down a predetermined up-down moving target object. The present disclosure also provides an inkjet printer equipped with such an up-down moving mechanism.

In order to solve the problems described above, an up-down moving mechanism of the present disclosure relates to an up-down moving mechanism that moves up and down a predetermined up-down moving target object, the up-down moving mechanism including a support member; an up-down moving member that is formed separately from the support member and coupled to the up-down moving target object, and that can be moved up and down with respect to the support member; a screw shaft for moving up and down the up-down moving member; a nut member that is screwed onto the screw shaft; a guide rail that guides the up-down moving member in a vertical direction; a guide block that slidably engages with the guide rail; and a gas spring that includes a cylinder and a piston rod biased in a direction projecting out from the cylinder, and that biases the up-down moving member toward an upper side with respect to the support member; in which to any one of the support member and the up-down moving member, the screw shaft is rotatably attached, the guide rail is fixed, and any one of the cylinder and the piston rod is attached.

In the up-down moving mechanism of the present disclosure, to any one of the support member and the up-down moving member, the screw shaft is rotatably attached, the guide rail is fixed, and any one of the cylinder and the piston rod of the gas spring is attached. That is, in the present disclosure, the screw shaft is rotatably attached, the guide rail is fixed, and any one of the cylinder and the piston rod is attached to a common member.

Therefore, in the present disclosure, the relative position accuracy between members of each of the screw shaft for moving up and down the up-down moving member, the guide rail for guiding the up-down moving member in the vertical direction, and the gas spring that biases the up-down moving member toward the upper side with respect to the support member can be increased. Therefore, in the present disclosure, the up-down moving member can be smoothly moved up and down with respect to the support member, and as a result, the up-down moving target object coupled to the up-down moving member can be smoothly moved up and down.

Preferably, in the present disclosure, to the support member, the screw shaft is rotatably attached, the guide rail is fixed, and any one of the cylinder and the piston rod is attached; and to the up-down moving member, the nut member is attached, the guide block is fixed, and other one of the cylinder and the piston rod is attached. With such a configuration, the weight of the structural object moved up and down with respect to the support member can be reduced compared to a case where the screw shaft and the guide rail are attached to the up-down moving member.

Preferably, in the present disclosure, the support member is a single member formed in a flat plate shape; a thickness direction of the support member is orthogonal to the vertical direction; and to one surface of the support member, the screw shaft is rotatably attached, the guide rail is fixed, and any one of the cylinder and the piston rod is attached. With such a configuration, the relative position accuracy between the members of each of the screw shaft, the guide rail and the gas springs can be further increased since the screw shaft, the guide rail, and the cylinder or the piston rod are attached to one surface of the support member formed as a plane. Therefore, the up-down moving member can be more smoothly moved up and down with respect to the support member.

Preferably in the present disclosure, the up-down moving mechanism further includes one screw shaft, two guide rails, and two gas springs; in which assuming that a direction orthogonal to the thickness direction of the support member and the vertical direction is a width direction of the support member, the screw shaft is rotatably attached to the support member at a center position of the support member in the width direction of the support member, each of the two gas springs is disposed on each side of the screw shaft in the width direction of the support member, and each of the two guide rails is fixed to the support member at each outer side of the two gas springs in the width direction of the support member.

With such a configuration, the up-down moving member can be biased toward the upper side in a balanced manner with respect to the support member, and the up-down moving member can be guided in a vertical direction in a balanced manner with respect to the support member. Therefore, the up-down moving member can be moved up and down in a balanced manner with respect to the support member, and as a result, the up-down moving member can be moved up and down more smoothly with respect to the support member.

Preferably, in the present disclosure, the screw shaft, the guide block, and the gas springs are disposed at substantially the same position in the thickness direction of the support member. With such a configuration, the up-down moving mechanism can be thinned in the thickness direction of the support member.

In the present disclosure, for example, the up-down moving mechanism includes a motor that rotates the screw shaft, and the motor is attached to the support member.

Preferably, in the present disclosure, the up-down moving mechanism includes an electromagnetic brake for stopping the rotation of the screw shaft, and a main body of the electromagnetic brake is attached to the support member. With such a configuration, the relative position accuracy between the screw shaft and the electromagnetic brake can be increased. Therefore, for example, the relative position accuracy between the disc of the electromagnetic brake fixed to the screw shaft and the main body of the electromagnetic brake can be increased, and as a result, brake can be reliably applied to the screw shaft by the electromagnetic brake.

The up-down moving mechanism of the present disclosure can be used in an inkjet printer. The inkjet printer includes, for example, two up-down moving mechanisms, an inkjet head that ejects ink droplets onto a print medium, a carriage on which the inkjet head is mounted, a carriage holding member that holds the carriage to be movable in a main scanning direction, and a table on which the print medium is placed, in which each of the two up-down moving mechanisms is disposed on each of both end sides of the table in the main scanning direction; the carriage holding member is the up-down moving target object; an end of the carriage holding member in the main scanning direction is coupled to the up-down moving member; the support member is coupled to the table; and the two up-down moving mechanisms move up and down the carriage holding member with respect to the table. In such an inkjet printer, the up-down moving member can be smoothly moved up and down with respect to the support member, and thus, the carriage holding member coupled to the up-down moving member can be smoothly moved up and down with respect to the table to which the support member is coupled.

Therefore, in the up-down moving mechanism of the present disclosure, the up-down moving target object can be smoothly moved up and down. Furthermore, in the inkjet printer of the present disclosure, the carriage holding member can be moved up and down smoothly with respect to the table.

DESCRIPTION OF EMBODIMENTS

Hereinafter, an embodiment of the present disclosure will be described with reference to the drawings.

(Schematic Configuration of Inkjet Printer)

Figure 1:
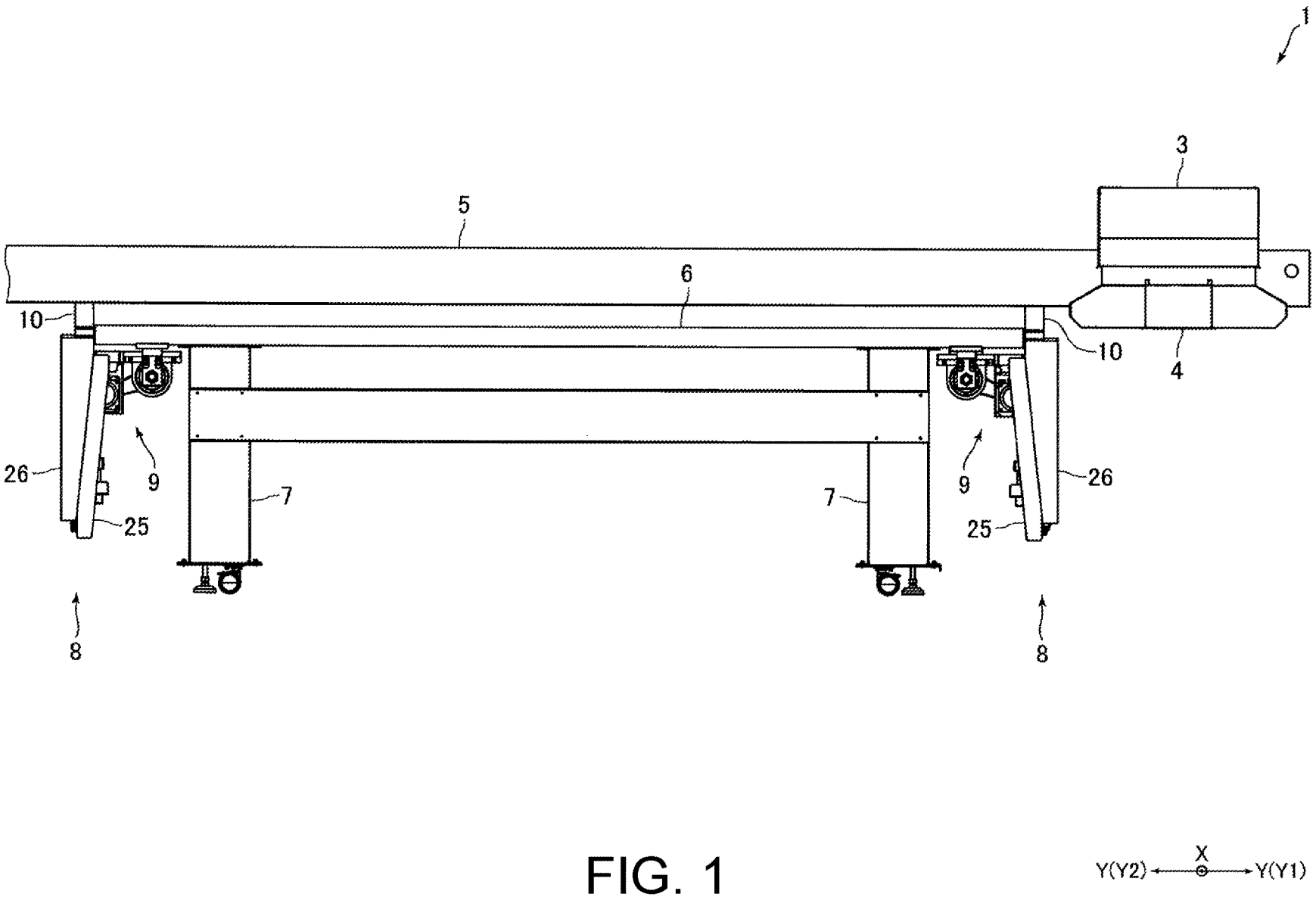
FIG. 1 is a front view of an inkjet printer according to an embodiment of the present disclosure.

FIG. 1 is a front view of an inkjet printer 1 according to an embodiment of the present disclosure.

The inkjet printer 1 (hereinafter referred to as "printer 1") of the present embodiment is, for example, a business inkjet printer that performs printing on a print medium such as print paper. The printer 1 of the present embodiment is a so-called flat bed type inkjet printer. The printer 1 includes an inkjet head 3 that ejects ink droplets onto a print medium, a carriage 4 on which the inkjet head 3 is mounted, a Y bar 5 serving as a carriage holding member that holds the carriage 4 so as to be movable in the main scanning direction, and a carriage moving mechanism (not shown) for moving the carriage 4 in the main scanning direction with respect to the Y bar 5.

The printer 1 also includes a table 6 on which a print medium is placed, and support legs 7 that support the table 6. Furthermore, the printer 1 includes an up-down moving mechanism 8 that moves up and down the Y bar 5 with respect to the table 6, and a slide mechanism 9 that slides the Y bar 5 with respect to the table 6 in the sub-scanning direction orthogonal to the vertical direction and the main scanning direction. In the following description, the main scanning direction (Y direction in FIG. 1 etc.) is assumed as "left-right direction" and the sub-scanning direction (X direction in FIG. 1 etc.) is assumed as "front-back direction". Furthermore, the Y1 direction side in FIG. 1 or the like which is one side in the left-right direction is referred to as the "right" side, and the Y2 direction side in FIG. 1, which is the opposite side, is referred to as the "left" side.

The carriage 4 is disposed on the upper side of the table 6. The inkjet head 3 ejects ink droplets from the upper side toward the print medium placed on the upper surface of the table 6. The ink discharged from the inkjet head 3 is, for example, an ultraviolet curable ink (UV ink). The carriage 4 is mounted with an ultraviolet irradiator that irradiates the ink ejected from the inkjet head 3 with ultraviolet rays. The carriage moving mechanism includes, for example, a motor, a driving pulley that rotates by the power of the motor, a driven pulley, and a belt applied across the driving pulley and the driven pulley. A part of the belt is fixed to the carriage 4.

The Y bar 5 is formed in a rectangular parallelepiped shape elongated in the left-right direction. Both left and right end portions of the Y bar 5 are supported from below by a Y bar support member 10. The table 6 is formed in a rectangular thick plate shape. The table 6 is disposed between the two Y bar support members 10 in the left-right direction. The support legs 7 support, for example, both front and rear end portions of the table 6 from below.

The slide mechanism 9 is disposed on each of the left and right ends of the table 6. In other words, the printer 1 includes two slide mechanisms 9. The slide mechanism 9 includes a motor and a ball screw. The fixed side of the slide mechanism 9 is fixed to the table 6. On the movable side (slide side) of the slide mechanism 9, a support member 14, which will be described later, forming the up-down moving mechanism 8 is fixed. The slide mechanism 9 moves the up-down moving mechanism 8 in the front-back direction together with the Y bar 5, the Y bar support member 10, and the like.

The up-down moving mechanism 8 is disposed on each of the left and right ends of the table 6. That is, the printer 1 includes two up-down moving mechanisms 8, and the two up-down moving mechanisms 8 move up and down the Y bar 5 with respect to the table 6. The Y bar 5 of the present embodiment is an up-down moving target object. Hereinafter, a specific configuration of the up-down moving mechanism 8 will be described. In the following description, the configuration of the up-down moving mechanism 8 disposed on the left side of the two up-down moving mechanisms 8 disposed on the left and right ends of the table 6 will be described.

(Configuration of Up-Down Moving Mechanism)

Figure 2:
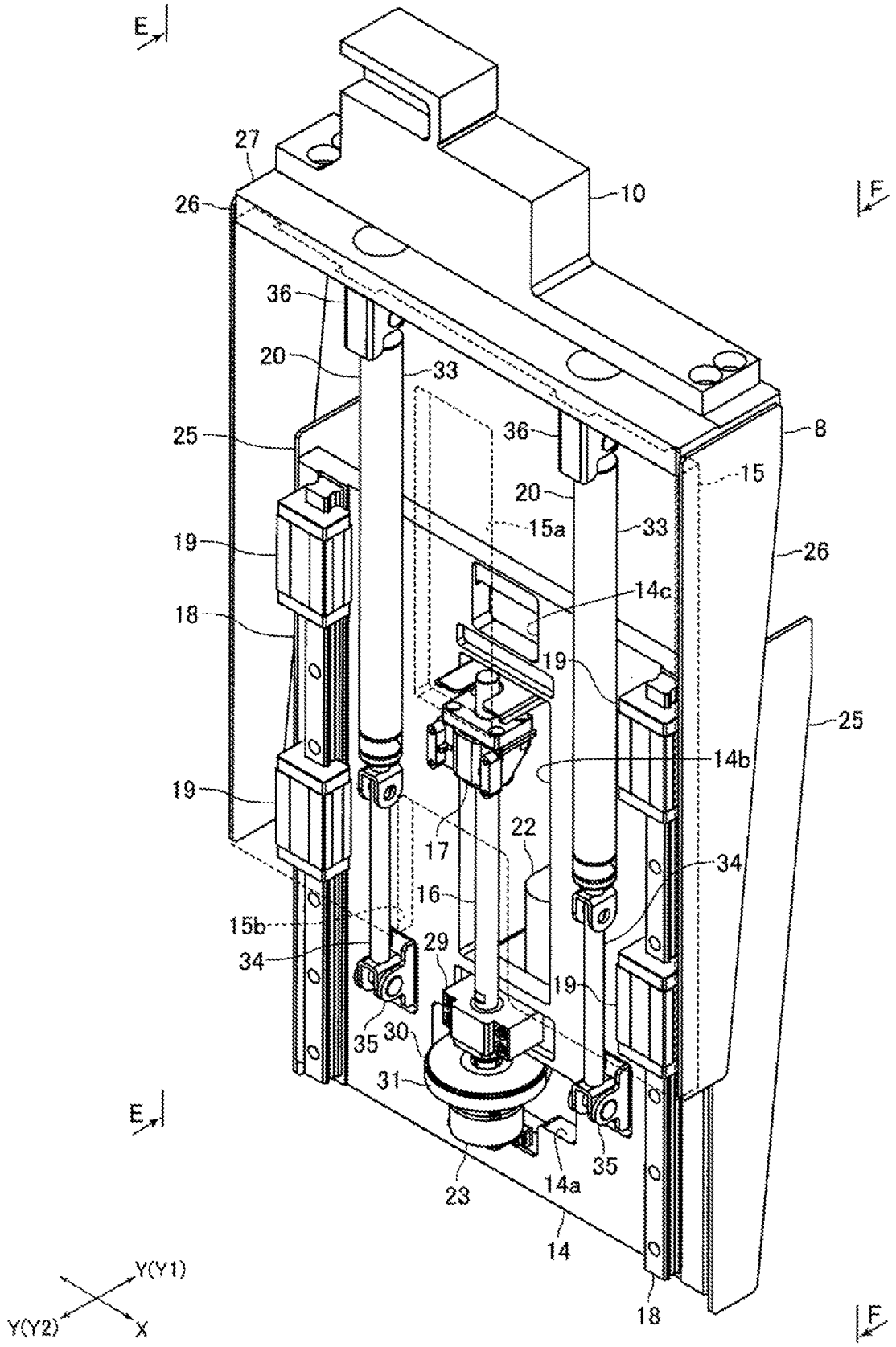
FIG. 2 is a perspective view for explaining the configuration of an up-down moving mechanism shown in FIG. 1.
Figure 3B:
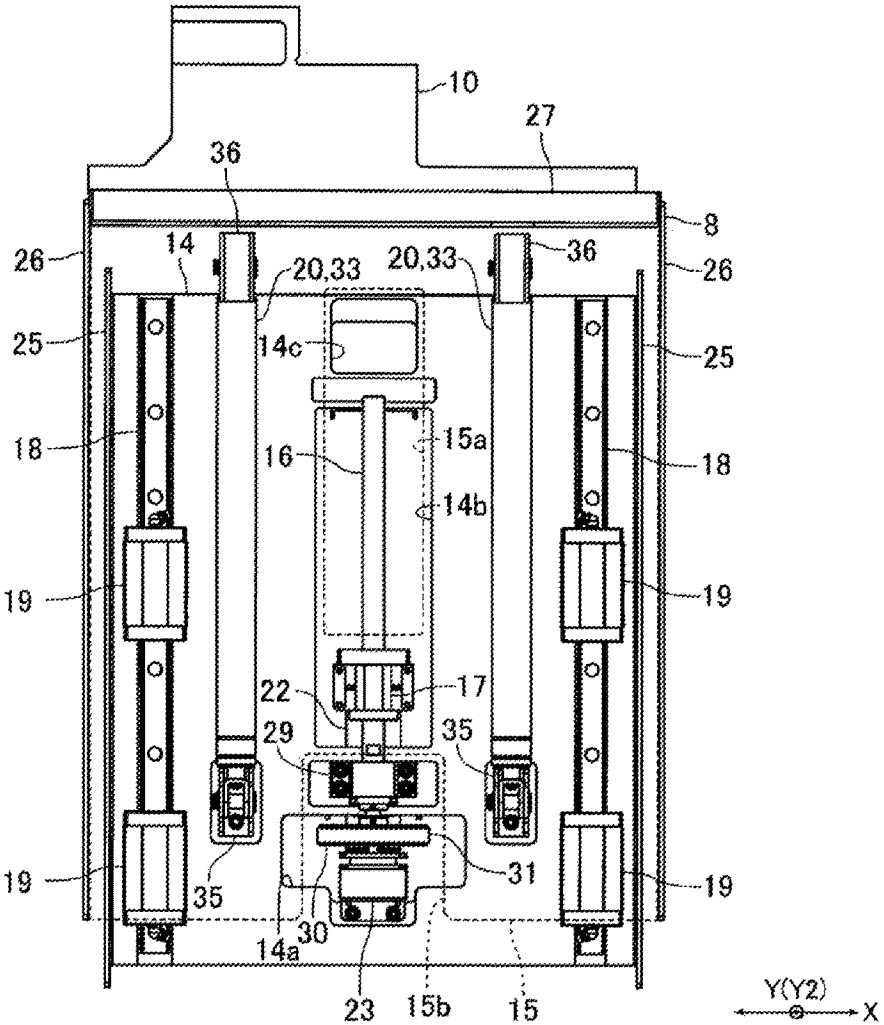
FIGS. 3A and 3B are side views for explaining the configuration and operation of the up-down moving mechanism from the E-E direction of FIG. 2.
Figure 3A:
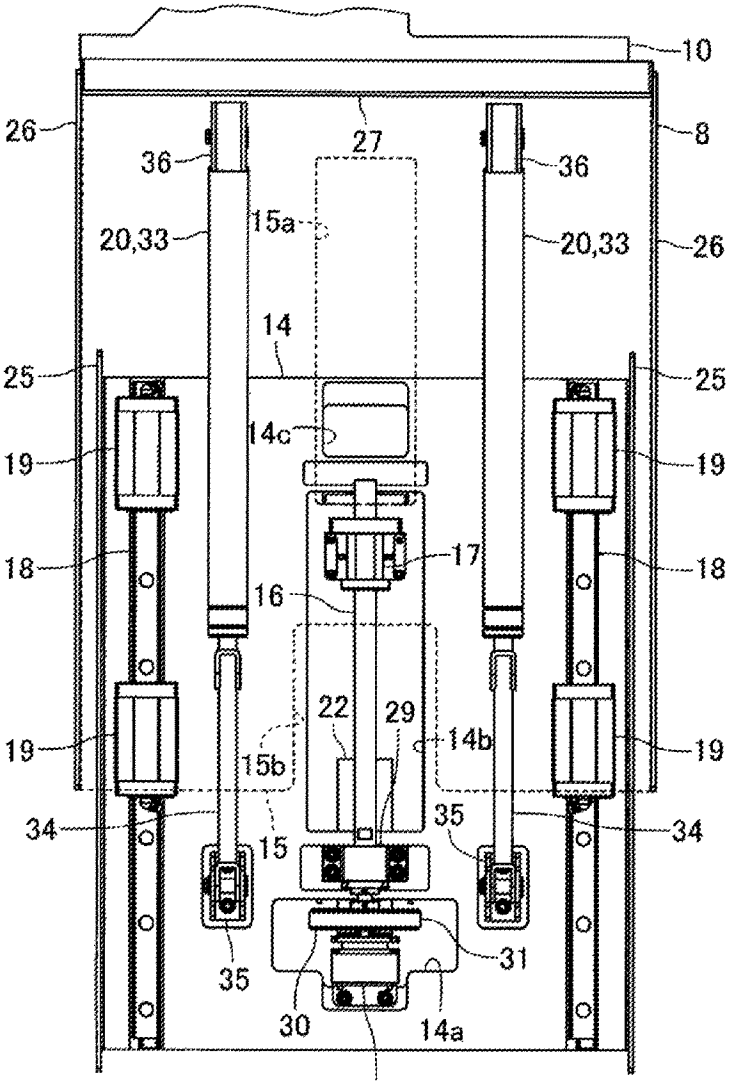
Figure 4B:
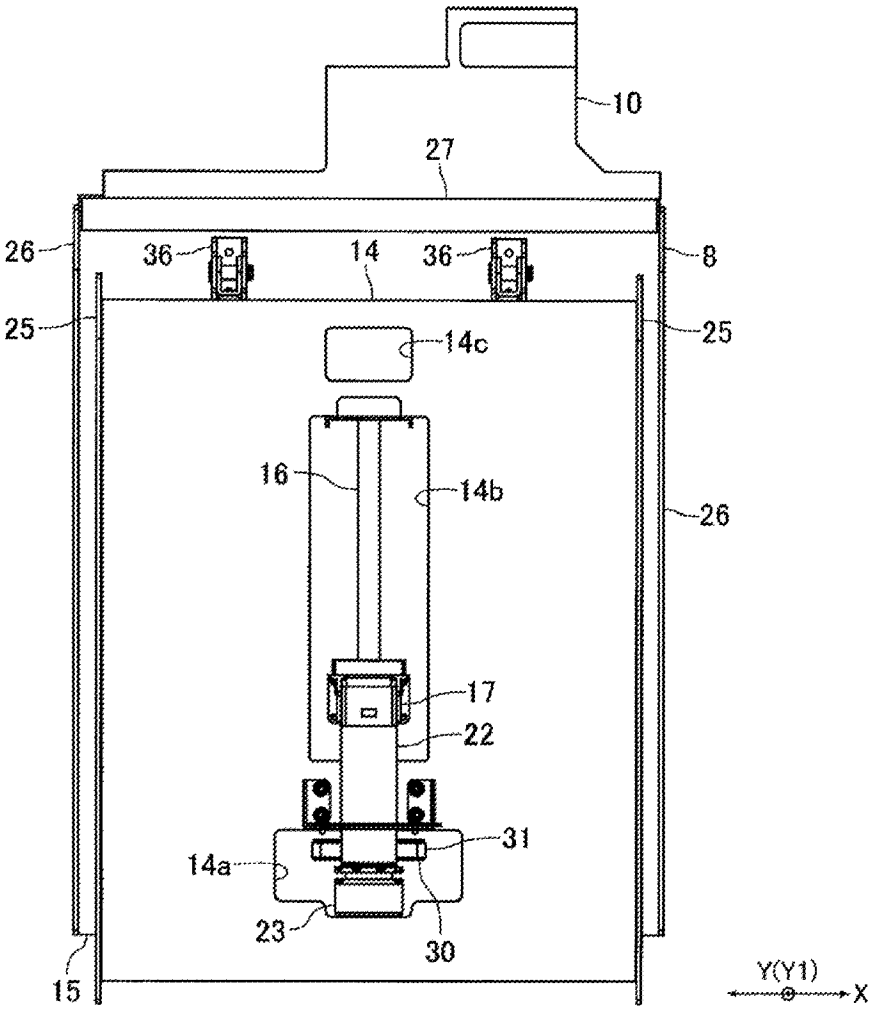
FIGS. 4A and 4B are side views for explaining the configuration and operation of the up-down moving mechanism from the F-F direction of FIG. 2.
Figure 4A:
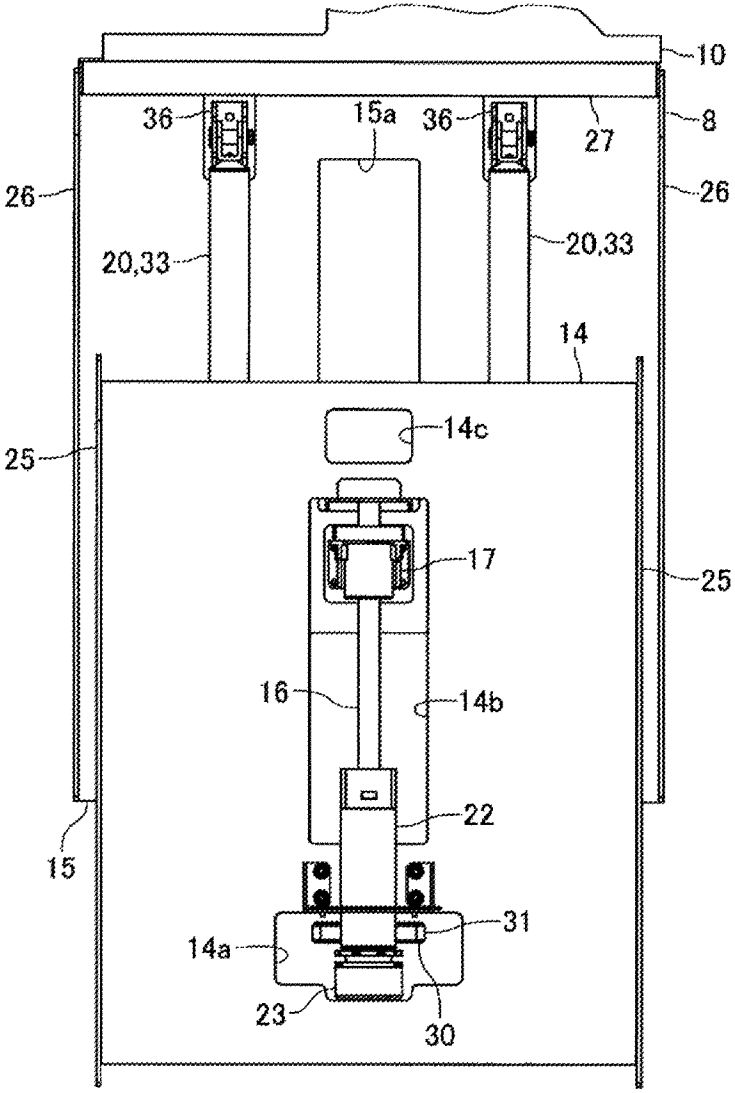

FIG. 2 is a perspective view for explaining the configuration of the up-down moving mechanism 8 shown in FIG. 1. FIGS. 3A and 3B are side views for explaining the configuration and operation of the up-down moving mechanism 8 from the E-E direction of FIG. 2. FIGS. 4A and 4B are side views for explaining the configuration and operation of the up-down moving mechanism 8 from the F-F direction of FIG. 2.

The up-down moving mechanism 8 includes a support member 14 and an up-down moving member 15 that is formed separately from the support member 14 and can be moved up and down with respect to the support member 14. The up-down moving mechanism 8 includes a ball screw including a screw shaft (lead screw) 16 for moving up and down the up-down moving member 15 and a nut member 17 screwed to the screw shaft 16, an LM guide having a guide rail 18 for guiding the up-down moving member 15 in the vertical direction and a guide block 19 that slidably engages with the guide rail 18, and a gas spring 20 for urging the up-down moving member 15 to the upper side with respect to the support member 14. In FIGS. 2, 3A and 3B, for the sake of convenience of explanation, the outer shape of the up-down moving member 15 is indicated by a broken line, and the up-down moving member 15 is illustrated in a transparent state.

The up-down moving mechanism 8 of the present embodiment includes one screw shaft 16, two guide rails 18, and two gas springs 20. One nut member 17 is screwed into the screw shaft 16. Two guide blocks 19 are engaged with one guide rail 18. That is, the up-down moving mechanism 8 includes four guide blocks 19. The up-down moving mechanism 8 includes a motor 22 that rotates the screw shaft 16 and an electromagnetic brake 23 that stops the rotation of the screw shaft 16.

The support member 14 is formed in a rectangular flat plate shape. That is, the support member 14 is a single member formed in a flat plate shape. The support member 14 is disposed so that the long side direction of the support member 14 formed in a rectangular shape and the vertical direction coincide with each other. Furthermore, the support member 14 is disposed so that the thickness direction of the support member 14 and the left-right direction coincide. That is, the left-right direction (Y direction) is the thickness direction of the support member 14, and the thickness direction of the support member 14 is orthogonal to the vertical direction. Note that, the front-back direction (X direction) of the present embodiment is the width direction of the support member 14 orthogonal to the thickness direction of the support member 14 and the vertical direction.

At the center portion of the support member 14 in the front-back direction, three through holes 14*a* to 14*c* that penetrate through the support member 14 in the left-right direction are formed. The through hole 14*a* is formed at the lower end portion of the support member 14. The through hole 14*b* is formed above the through hole 14*a*, and the through hole 14*c* is formed above the through hole 14*b*. Thin plate-like side plates 25 are fixed to both front and back end faces of the support member 14. The left end face of the side plate 25 is disposed on the right side of the left surface of the support member 14. The right surface of the support member 14 is fixed to the movable side of the slide mechanism 9. That is, the support member 14 is coupled to the table 6 by way of the slide mechanism 9.

Similar to the support member 14, the up-down moving member 15 is formed in a rectangular flat plate shape. That is, the up-down moving member 15 is a single member formed in a flat plate shape. The up-down moving member 15 is disposed so that the long side direction of the up-down moving member 15 formed in a rectangular shape coincides with the vertical direction. Furthermore, the up-down moving member 15 is disposed so that the thickness direction of the up-down moving member 15 coincides with the left-right direction. The up-down moving member 15 is disposed on the left side of the support member 14. A through hole 15*a* penetrating the up-down moving member 15 in the left-right direction is formed at the center portion of the up-down moving member 15 in the front-back direction. In addition, a notch 15*b* for avoiding interference between the electromagnetic brake 23, a bearing 29 and a pulley 30, which will be described later, and the up-down moving member 15 is formed at the lower end of the center portion of the up-down moving member 15 in the front-back direction.

Thin plate-like side plates 26 are fixed to both front and back end faces of the up-down moving member 15. The left end face of the side plate 26 is disposed on the right side of the left surface of the up-down moving member 15. Furthermore, the width in the front-back direction of the up-down moving member 15 is wider than the width in the front-back direction of the support member 14, and the two side plates 26 are disposed on the outer side of the two side plates 25 in the front-back direction. A support plate 27 formed in a flat plate shape is fixed to the upper end face of the up-down moving member 15. The lower surface of the Y bar support member 10 is fixed to the upper surface of the support plate 27. In other words, the up-down moving member 15 is coupled to the Y bar 5 which is the up-down moving target object through the support plate 27 and the Y bar support member 10. Specifically, the left end portion of the Y bar 5 is coupled to the up-down moving member 15.

The screw shaft 16 is disposed so that the axial direction of the screw shaft 16 and the vertical direction coincide. The screw shaft 16 is rotatably held by the bearing 29. The bearing 29 is attached to the left surface of the support member 14. That is, the screw shaft 16 is rotatably attached to the left surface of the support member 14 through the bearing 29. Furthermore, the screw shaft 16 is rotatably attached to the support member 14 at the center position of the support member 14 in the front-back direction. The bearing 29 holds the lower end side of the screw shaft 16. The nut member 17 is attached to the up-down moving member 15. Specifically, the nut member 17 is fixed to the right surface of the up-down moving member 15. In addition to the bearing 29, the up-down moving mechanism 8 may include a bearing that rotatably holds the upper end side of the screw shaft 16.

The motor 22 is a servo motor. The motor 22 is attached to the support member 14. Specifically, the motor 22 is fixed to the right surface of the support member 14. The output shaft of the motor 22 projects out to the lower side. A pulley is fixed to the output shaft of the motor 22, and a pulley 30 is also fixed to the lower end portion of the screw shaft 16. A belt 31 is applied across a pulley fixed to the output shaft of the motor 22 and the pulley 30. A part of the pulley 30 and a part of the belt 31 are disposed in the through hole 14*a* of the support member 14.

The electromagnetic brake 23 is a non-excitation operation type electromagnetic brake in which a brake force acts at the time of non-energization. The main body of the electromagnetic brake 23 is attached to the support member 14. Specifically, the main body of the electromagnetic brake 23 is fixed to the left surface of the support member 14. A disk of the electromagnetic brake 23 is fixed to the lower end portion of the screw shaft 16. When the screw shaft 16 is rotated, the electromagnetic brake 23 is in an energized state so that the brake force of the electromagnetic brake 23 does not act.

On the other hand, when maintaining a stopped state of the screw shaft 16, the electromagnetic brake 23 is in a non-energized state so that the brake force of the electromagnetic brake 23 acts. When the brake force of the electromagnetic brake 23 is acting, a state in which the up-down moving member 15 is stopped with respect to the support member 14 is maintained, and a distance in the vertical direction between the Y bar 5 and the table 6 is kept constant. For example, when printing on a print medium, the electromagnetic brake 23 is in a non-energized state, and the distance in the vertical direction between the Y bar 5 and the table 6 is kept constant.

The guide rail 18 is disposed so that the longitudinal direction of the guide rail 18 coincides with the vertical direction. The guide rail 18 is fixed to the support member 14. Specifically, the guide rail 18 is fixed to the left surface of the support member 14. Furthermore, each of the two guide rails 18 is fixed to each of both front and back ends of the support member 14. The guide block 19 is fixed to the up-down moving member 15. Specifically, the guide block 19 is fixed to the right surface of the up-down moving member 15, and is engaged with the guide rail 18 from the left side.

The gas spring 20 includes a cylinder 33 that forms a main body of the gas spring 20 and a piston rod 34 that is biased in a direction projecting out from the cylinder 33. The piston rod 34 is biased in a direction projecting out from the cylinder 33 by the compressed gas sealed inside the cylinder 33. The gas spring 20 is disposed so that the longitudinal direction of the gas spring 20 coincides with the vertical direction. The gas spring 20 is disposed so that the piston rod 34 projects out downward.

The distal end portion (lower end portion) of the piston rod 34 is turnably held by the rod holding member 35. The distal end portion of the piston rod 34 can be turned with respect to the rod holding member 35 with the front-back direction as the axial direction of turning. The rod holding member 35 is fixed to the support member 14. That is, the piston rod 34 is attached to the support member 14 through the rod holding member 35. Specifically, the rod holding member 35 is fixed to the lower end side of the left surface of the support member 14, and the piston rod 34 is attached to the left surface of the support member 14 through the rod holding member 35.

The upper end portion of the cylinder 33 is turnably held by the cylinder holding member 36. The upper end portion of the cylinder 33 can be turned with respect to the cylinder holding member 36 with the front-back direction as the axial direction of turning. The cylinder holding member 36 is fixed to the up-down moving member 15. That is, the cylinder 33 is attached to the up-down moving member 15 through the cylinder holding member 36. Specifically, the cylinder holding member 36 is fixed to the upper end side of the right surface of the up-down moving member 15, and the cylinder 33 is attached to the right surface of the up-down moving member 15 through the cylinder holding member 36.

Each of the two gas springs 20 is disposed on each of both the front and back sides of the screw shaft 16. The gas spring 20 is disposed between the screw shaft 16 and the guide rail 18 in the front-back direction. That is, each of the two guide rails 18 is disposed on each of the front and back outer sides of the two gas springs 20. In the present embodiment, as shown in FIG. 2, the screw shaft 16, the guide block 19, and the gas spring 20 are disposed at substantially the same position in the left-right direction.

In the up-down moving mechanism 8, when the motor 22 is driven, the up-down moving member 15 moves up and down with respect to the support member 14 along the guide rail 18. Specifically, when the motor 22 is driven, the up-down moving member 15 moves up and down with respect to the support member 14 between the upper limit position shown in FIGS. 3A and 4A and the lower limit position shown in FIGS. 3B and 4B. That is, when the motor 22 is driven, the Y bar 5 moves up and down with respect to the table 6. The up/down moving amount of the up-down moving member 15 with respect to the support member 14 is, for example, 150 (mm). Furthermore, the biasing force of the gas spring 20 becomes maximum when the up-down moving member 15 is at the lower limit position, and becomes smaller as the up-down moving member 15 rises from the lower limit position.

(Main Effect of the Present Embodiment)

As described above, in the present embodiment, the screw shaft 16 is rotatably attached, the guide rail 18 is fixed, and the piston rod 34 of the gas spring 20 is attached to the support member 14. Therefore, in the present embodiment, the relative position accuracy between members of each of the screw shaft 16 for moving up and down the up-down moving member 15, the guide rail 18 for guiding the up-down moving member 15 in the vertical direction, and the gas spring 20 that biases the up-down moving member 15 toward the upper side with respect to the support member 14 can be increased. Therefore, in the present embodiment, the up-down moving member 15 can be smoothly moved up and down with respect to the support member 14, and as a result, the Y bar 5 coupled to the up-down moving member 15 can be smoothly moved up and down with respect to the table 6 to which the support member 14 is coupled.

In particular, in the present embodiment, the screw shaft 16 is rotatably attached, the guide rail 18 is fixed, and the piston rod 34 is attached to the left surface of the support member 14 which is a flat surface, so that the relative position accuracy between members of each of the screw shaft 16, the guide rail 18, and the gas spring 20 can be further increased. Therefore, in the present embodiment, the up-down moving member 15 can be more smoothly moved up and down with respect to the support member 14.

Furthermore, in the present embodiment, the screw shaft 16 is rotatably attached to the support member 14 at the center position of the support member 14 in the front-back direction, and each of the two gas springs 20 is disposed on both front and back sides of the screw shaft 16, and each of the two guide rails 18 are respectively disposed on the front and Back outer sides of the two gas springs 20. Therefore, in the present embodiment, the up-down moving member 15 can be biased toward the upper side in a balanced manner with respect to the support member 14, and the up-down moving member 15 can be guided in a vertical direction in a balanced manner with respect to the support member 14. Therefore, in the present embodiment, the up-down moving member 15 can be moved up and down in a balanced manner with respect to the support member 14, and as a result, the up-down moving member 15 can be moved up and down more smoothly with respect to the support member 14.

In the present embodiment, the screw shaft 16, the guide block 19, and the gas spring 20 are disposed at substantially the same position in the left-right direction. Therefore, in the present embodiment, the up-down moving mechanism 8 can be thinned in the left-right direction.

In the present embodiment, the main body of the electromagnetic brake 23 is fixed to the support member 14 to which the screw shaft 16 is attached. Therefore, in the present embodiment, the relative position accuracy between the screw shaft 16 and the electromagnetic brake 23 can be increased. Therefore, in the present embodiment, the relative position accuracy between the disc of the electromagnetic brake 23 fixed to the screw shaft 16 and the main body of the electromagnetic brake 23 can be increased, and as a result, brake can be reliably applied on the screw shaft 16 by the electromagnetic brake 23.

Other Embodiments

The embodiment described above is an example of a preferred embodiment of the present disclosure, but the present disclosure is not limited thereto, and various modifications can be made without changing the gist of the present disclosure.

In the embodiment described above, the cylinder 33 may be attached to the support member 14 and the piston rod 34 may be attached to the up-down moving member 15. In the mode described above, the screw shaft 16 is rotatably attached and the guide rail 18 is fixed to the up-down moving member 15, and the nut member 17 is attached and the guide block 19 is fixed to the support member 14. However, as described above, the weight of the structural object that moves up and down relative to the support member 14 can be reduced if the screw shaft 16 and the guide rail 18 are attached to the support member 14.

In the embodiment described above, the two gas springs 20 may be disposed on the front and back outer sides of the two guide rails 18, respectively. Furthermore, in the embodiment described above, any one of the screw shaft 16, the guide block 19 and the gas spring 20 may be disposed at a position shifted in the left-right direction, or the screw shaft 16, the guide block 19 and the gas spring 20 may be disposed at positions shifted from each other in the left-right direction.

In the embodiment described above, the printer 1 may be a shaping device that forms a three-dimensional object on the table 6. Furthermore, in the embodiment described above, the up-down moving mechanism 8 moves up and down the Y bar 5, but the up-down moving mechanism 8 may, for example, move up and down the table 6. In this case, the table 6 is an up-down moving target object. Furthermore, the up-down moving mechanism 8 to which the present disclosure is applied may be used in devices other than the printer 1.

What is claimed is:

1. An up-down moving mechanism that moves up and down an up-down moving target object that is predetermined, and the up-down moving mechanism comprising:

a support member;

an up-down moving member that is provided separately from the support member and coupled to the up-down moving target object, and that moves up and down with respect to the support member;

a screw shaft for moving up and down the up-down moving member;

a nut member that is screwed onto the screw shaft;

a guide rail that guides the up-down moving member in a vertical direction;

a guide block that slidably engages with the guide rail; and a gas spring that includes a cylinder and a piston rod biased in a direction projecting out from the cylinder, and that biases the up-down moving member toward an upper side with respect to the support member, wherein to any one of the support member and the up-down moving member, the screw shaft is rotatably attached, the guide rail is fixed, and any one of the cylinder and the piston rod is attached.

2. The up-down moving mechanism according to claim 1, wherein to the support member, the screw shaft is rotatably attached, the guide rail is fixed, and any one of the cylinder and the piston rod is attached, and to the up-down moving member, the nut member is attached, the guide block is fixed, and any other one of the cylinder and the piston rod is attached.

3. The up-down moving mechanism according to claim 2, wherein the support member is a single member provided in a flat plate shape, a thickness direction of the support member is orthogonal to a vertical direction, and to one surface of the support member, the screw shaft is rotatably attached, the guide rail is fixed, and any one of the cylinder and the piston rod is attached.

4. The up-down moving mechanism according to claim 3, further comprising:

one of the screw shaft, two of the guide rails, and two of the gas springs, wherein a direction orthogonal to the thickness direction of the support member and the vertical direction is set as a width direction of the support member, the screw shaft is rotatably attached to the support member at a center position of the support member in the width direction of the support member, each of the two gas springs is disposed on each of both sides of the screw shaft in the width direction of the support member, and each of the two guide rails is fixed to the support member at each outer side of the two gas springs in the width direction of the support member.

5. The up-down moving mechanism according to claim 3, wherein the screw shaft, the guide block, and the gas spring are disposed at substantially the same position in the thickness direction of the support member.

6. The up-down moving mechanism according to claim 4, wherein the screw shaft, the guide block, and the gas spring are disposed at substantially the same position in the thickness direction of the support member.

7. The up-down moving mechanism according to claim 2, further comprising:

a motor for rotating the screw shaft, wherein the motor is attached to the support member.

8. The up-down moving mechanism according to claim 3, further comprising:

a motor for rotating the screw shaft, wherein the motor is attached to the support member.

9. The up-down moving mechanism according to claim 4, further comprising:

a motor for rotating the screw shaft, wherein the motor is attached to the support member.

10. The up-down moving mechanism according to claim 5, further comprising:

a motor for rotating the screw shaft, wherein the motor is attached to the support member.

11. The up-down moving mechanism according to claim 6, further comprising:

a motor for rotating the screw shaft, wherein the motor is attached to the support member.

12. The up-down moving mechanism according to claim 2, further comprising:

an electromagnetic brake for stopping a rotation of the screw shaft, wherein a main body of the electromagnetic brake is attached to the support member.

13. The up-down moving mechanism according to claim 3, further comprising:

an electromagnetic brake for stopping a rotation of the screw shaft, wherein a main body of the electromagnetic brake is attached to the support member.

14. The up-down moving mechanism according to claim 4, further comprising:

an electromagnetic brake for stopping a rotation of the screw shaft, wherein a main body of the electromagnetic brake is attached to the support member.

15. The up-down moving mechanism according to claim 5, further comprising:

an electromagnetic brake for stopping a rotation of the screw shaft, wherein a main body of the electromagnetic brake is attached to the support member.

16. The up-down moving mechanism according to claim 6, further comprising:

an electromagnetic brake for stopping a rotation of the screw shaft, wherein a main body of the electromagnetic brake is attached to the support member.

17. The up-down moving mechanism according to claim 7, further comprising:

an electromagnetic brake for stopping a rotation of the screw shaft, wherein a main body of the electromagnetic brake is attached to the support member.

18. The up-down moving mechanism according to claim 8, further comprising:

an electromagnetic brake for stopping a rotation of the screw shaft, wherein a main body of the electromagnetic brake is attached to the support member.

19. The up-down moving mechanism according to claim 9, further comprising:

an electromagnetic brake for stopping a rotation of the screw shaft, wherein a main body of the electromagnetic brake is attached to the support member.

20. An inkjet printer comprising:

two up-down moving mechanisms according to claim 1, an inkjet head that ejects ink droplets onto a print medium, a carriage on which the inkjet head is mounted, a carriage holding member that holds the carriage to be movable in a main scanning direction, and a table on which the print medium is placed, wherein each of the two up-down moving mechanisms is disposed on each of both end sides of the table in the main scanning direction, the carriage holding member is the up-down moving target object, an end of the carriage holding member in the main scanning direction is coupled to the up-down moving member, the support member is coupled to the table, and the two up-down moving mechanisms move up and down the carriage holding member with respect to the table.

* * * * *